United States Patent [19]

DeMars

[11] Patent Number: 4,585,424

[45] Date of Patent: Apr. 29, 1986

[54] BASHFUL BEAR

[76] Inventor: Robert DeMars, 7932 Maestro Ave., Canoga Park, Calif. 91304

[21] Appl. No.: 740,343

[22] Filed: Jun. 3, 1985

[51] Int. Cl.[4] ..... A63H 3/00

[52] U.S. Cl. ..... 446/295; 446/372; 446/485

[58] Field of Search ..... 446/268, 295, 296, 321, 446/337, 365, 485, 369, 372, 391

[56] References Cited

U.S. PATENT DOCUMENTS

| | | | |
|---|---|---|---|
| 2,794,298 | 6/1957 | Mason | 446/485 X |
| 3,190,037 | 6/1965 | Giordano | 446/391 X |
| 3,808,418 | 4/1974 | Conard et al. | 446/485 X |
| 4,464,861 | 8/1984 | Fogarty et al. | 446/485 X |

FOREIGN PATENT DOCUMENTS

| | | | |
|---|---|---|---|
| 2066089 | 7/1981 | United Kingdom | 446/485 |

*Primary Examiner*—Mickey Yu

*Attorney, Agent, or Firm*—Cislo, O'Reilly & Thomas

[57] ABSTRACT

A toy doll (10), in particular, a toy bear, is provided with a bashful demeanor. The demeanor is enhanced by further providing the bear with apparatus for simulating blushing. The blushing effect is achieved by employing a face plate (12) which includes at least the cheek portions of the face, is tinted red, and transmits light. Illumination (24) is provided by lamps (**24*a*, 24*b*) behind the face plate. The lamps are activated by a power source (18), such as at least one battery. A variable resistor (38) controls the amount of power to the lamps. The variable resistor is activated by pressing in on the back area (40) and/or the abdominal area (16**); the greater the pressure, the more current supplied to the lamps and hence the greater the intensity of light.

8 Claims, 7 Drawing Figures

BASHFUL BEAR

BACKGROUND OF THE INVENTION

This invention relates to toys, and, more particularly, to a bear capable of exhibiting an appearance suggestive of bashfulness.

It is known to provide dolls with various types of response devices to simulate realism. For example, U.S. Pat. No. 3,239,961 discloses a doll provided with eyes that light up, cheeks that redden, hair that stands on end and lips that simulate a kiss. U.S. Pat. No. 4,075,782 discloses a doll showing sickness and means for "curing".

OBJECTS AND SUMMARY OF THE INVENTION

It is an object of the present invention to provide a doll having a bashful demeanor.

It is a further object of the present invention to provide a bashful bear doll capable of exhibiting a blushing response.

It is yet another object of the present invention to provide a bashful bear doll capable of exhibiting a blushing response that may be varied.

These and further objects of the invention will become apparent from the hereinafter following commentary taken in conjunction with the drawing.

In accordance with the invention, a doll, especially a toy bear, is provided with a bashful demeanor and capable of exhibiting a blushing response that varies with the extent of pressure applied to the doll. The doll includes: (a) red-tinted light-transmitting face plate means; (b) at least one lamp interior the doll and associated with the face plate means; (c) a power source for supplying power to the lamp; and (d) means for varying the power supplied to the lamp.

As a varying degree of pressure is applied to the doll, for example, in either the abdominal or back region, the lamp exhibits a corresponding intensity varying with the pressure applied. In this manner, the doll exhibits varying degrees of blushing.

DETAILED DESCRIPTION OF THE PREFERRED EMBODIMENTS

Figure 1:
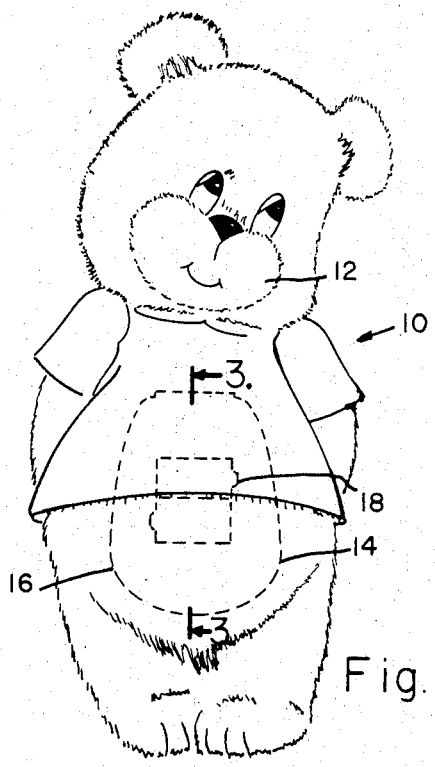
FIG. 1 is a front elevation view of a doll, here, a toy bear, exhibiting a bashful demeanor, with the blushing activating mechanism shown in phantom.

Referring to the drawing wherein like numerals of reference designate like elements throughout, a doll 10 is depicted. While the doll 10 may possess the characteristics of an animal, anthropomorphized animal or humanoid, preferably the doll is a toy bear, as depicted in the drawing. It will be seen that the bear is provided with a bashful demeanor; that is, the feet are pointed in, the hands are behind the back, the head is tilted to one side, and the eyes look upward. In order to complete the demeanor of bashfulness, a face plate 12 is provided, which, in conjunction with apparatus described below, is capable of being illuminated a reddish color, to simulate blushing of the cheeks. The face plate 12 is translucent and is tinted a reddish color, such that upon illimination, the blushing effect is obtained.

A compartment 14 is provided in the abdominal region 16 of the bear 10, with provision for maintaining a source of power 18 therein. The source of power 18 is provided by at least one battery; here, two batteries 18*a*, 18*b* are shown in head-to-tail configuration.

The power source 18 is maintained in a sub-compartment 20, which projects into the interior of the compartment 14. Access means 22 conveniently comprises a hatch provided with a catch, which allows entry to the sub-compartment 20, thus permitting the power source to be changed periodically, as when batteries run down.

Behind the face plate 12 is an illumination means 24, which is electrically connected with the power source 18 by means of a cable 26. Preferably, two lamps or bulbs 24*a*, 24*b* are employed, each associated with a corresponding cheek 12*a*, 12*b* of the face plate 12.

The illumination means 24 is retained in a socket holder 30, mounted on a substrate 28. For two lamps 24*a*, 24*b*, there is a corresponding socket holder 30*a*, 30*b*. Electrical connection of the cable 26 is made to corresponding contacts 32*a*, 32*b* of the socket holder 30*a*, 32*b*.

The face plate 12 is provided with a flange 34, which is releasably attached to a corresponding receiving flange 36 on the substrate 28. The attachment may be made by any convenient means; preferably, a semi-permanent attachment, such as snap-fit, is employed, in order to gain easy access to the illuminating means 24 in the event of malfunction, burn-out or other reasons.

Figure 3:
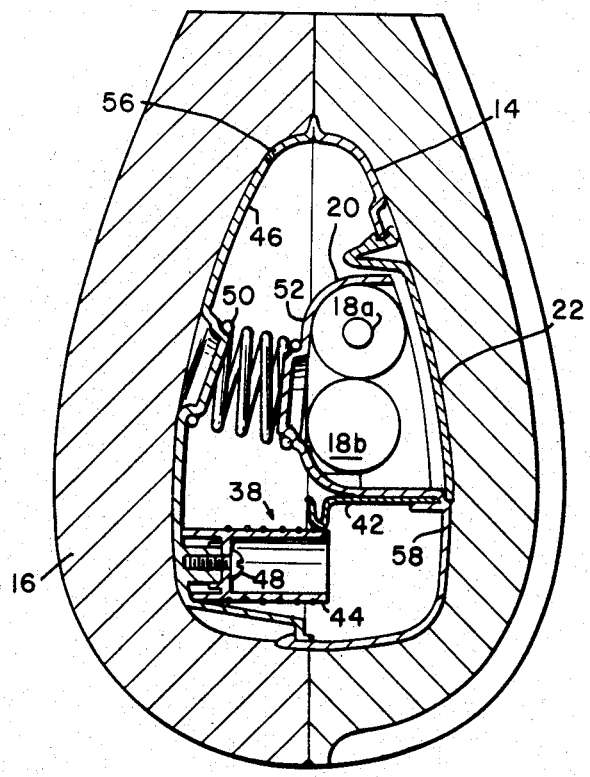
FIG. 3 is an enlarged view taken in cross-section along the line 3—3 of FIG. 2, showing the back of the doll in the normal, unsqueezed position.
Figure 4:
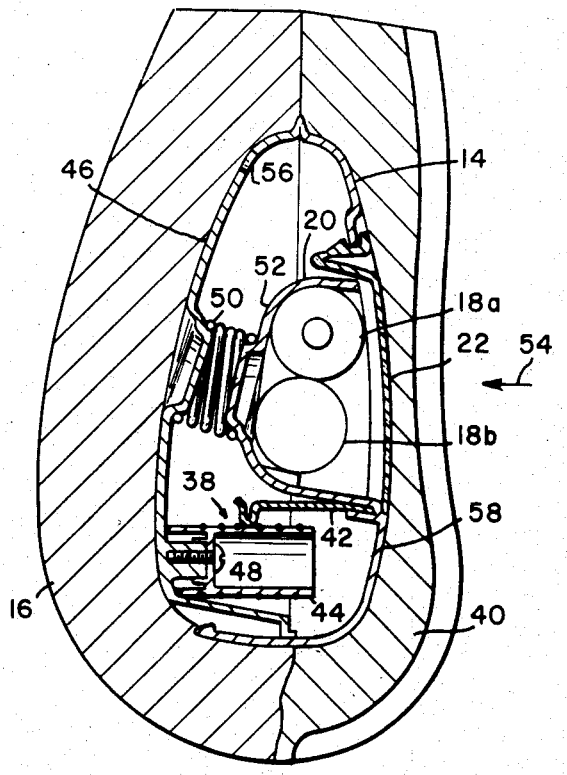
FIG. 4 is a view similar to that of FIG. 3, but showing the back in a squeezed position.
Figure 5:
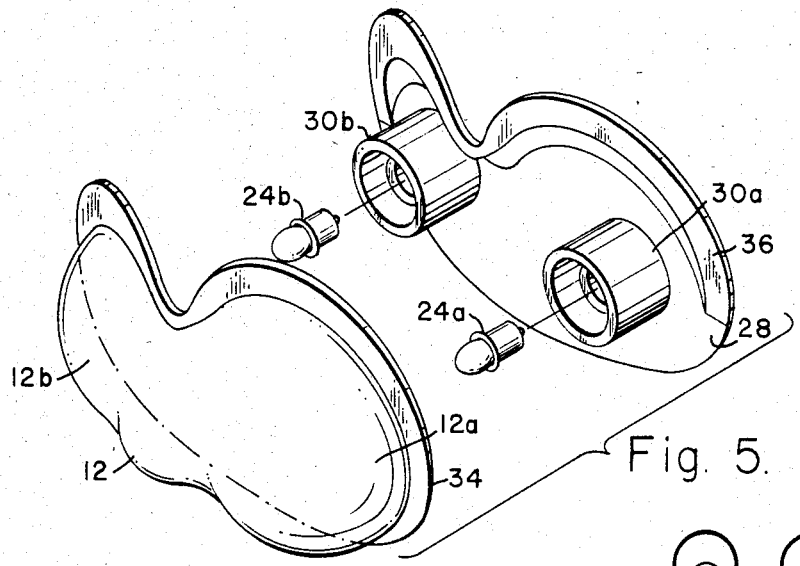
FIG. 5 is a three-dimensional exploded view of a portion of the face of the doll, showing the relationship with the illumination means.
Figure 6:
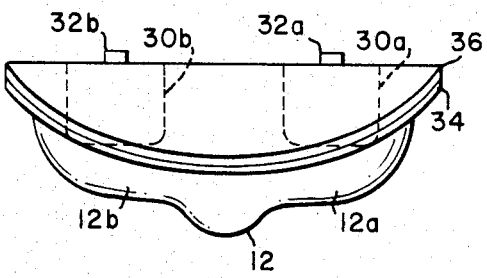
FIG. 6 is a top view of the arrangement depicted in FIG. 5, assembled.
Figure 7:
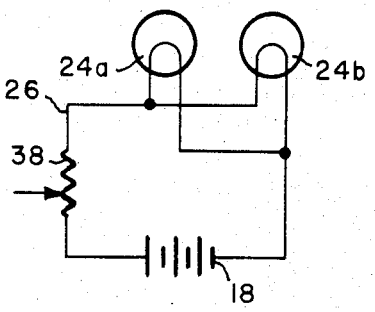
FIG. 7 is a schematic electrical diagram of the circuit employed in the invention.

The blushing effect is variable, as provided by a rheostat 38, located within the cavity 14. As more clearly seen in FIGS. 3 and 4, applying pressure to the back wall 40 and/or to the abdominal wall 16 of the toy bear moves a contact 42 across the surface of a variable resistor 44. Conveniently, the variable resistor 44 comprises a wire-wound resistor. As an example, the core of the resistor may comprise a cylinder of styrene, provided with a spiral groove in which the wire is wound. The wire may comprise any of the metals and alloys commonly employed as resistance wire.

Figure 2:
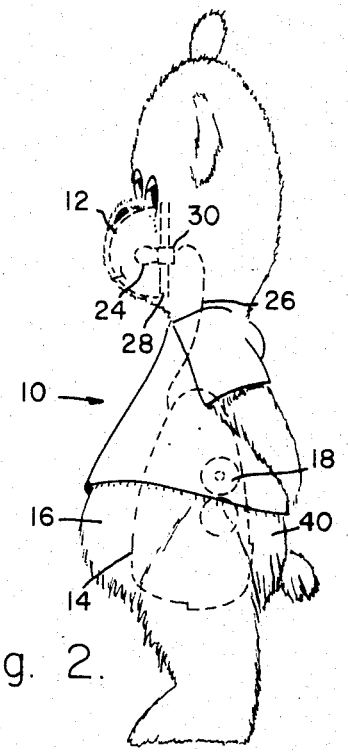
FIG. 2 is a side elevation view of the doll of FIG. 1, showing in phantom the relationship between the blushing activating mechanism and the lamp simulating the blushing.

The variable resistor 44 is mounted on the front inside wall 46 of the compartment 14 by means of a screw 48. A spring 50 is maintained between the front wall 46 of the compartment 14 and the interior wall 52 of the sub-compartment 20. The spring 50 serves to maintain the compartment 14 in its fully expanded condition, such that after applying pressure, as denoted by arrow 54, shown in FIG. 3, the compartment returns to its original position, shown in FIG. 2.

The compartment 14 comprises a resilient material capable of yielding under pressure. The compartment 14 is provided with an opening 56, through which the cable 26 is passed.

The operation of the toy to produce the blushing effect is based on applying pressure, as by squeezing the doll in the back area 40, indicated by arrow 54. Alternatively, pressure may be applied to the abdominal region 16 or to the back area 40 and the abdominal region 16 simultaneously. The inward pressure against the compartment 14 causes spring contact 42, which is attached to the rear wall 58 of the compartment 14, to move across the variable resistor 44. The location of the spring contact 42 determines the amount of power which reaches the illumination means 24. The variable resistor 44 is wound such that the further the spring contact 42 travels, the more power reaches the illumination means 24. Consequently, the lamps 24 burn more brightly with a greater degree of applied pressure. Since the face plate 12 is of reddish tint and passes light, it will be appreciated that a blushing action is realized, which varies as a function of the extent of pressure applied to the toy.

Thus, there has been disclosed a toy having a bashful demeanor which is enhanced by the simulation of blushing, the blushing effect being variable. Various modifications and changes will make themselves available to those of ordinary skill in the art, and all such changes and variances not deviating from the spirit and essence of the invention are intended to be covered by the appended claims.

What is claimed is:

1. A toy doll provided with means conveying a bashful demeanor and capable of exhibiting a variable blushing response, said means comprising:

(a) red-tinted light-transmitting face plate means defining cheek portions of said doll;

(b) an illumination means interior said doll and associated with said face plate means, said illumination means comprising two lamps, each associated with one cheek of said toy doll;

(c) a power source for activating said illumination means; and (d) means for varying the power supplied to said illumination means as a function of the extent to which a portion of said toy doll is squeezed, said power varying means comprising a variable resistor mechanically coupled to said portion of said doll.

2. The toy doll of claim 1 wherein said toy doll is a toy bear.

3. The toy doll of claim 1 wherein said variable resistor comprises a wire-wound resistor.

4. The toy doll of claim 1 wherein said power source comprises at least one battery.

5. A toy bear provided with means conveying a bashful demeanor and capable of exhibiting a variable blushing response, said means comprising:

(a) red-tinted light-transmitting face plate means defining cheek portions;

(b) an illumination means interior said toy bear and associated with said face plate means, said illumination means comprising two lamps, each associated with a cheek portion;

(c) a power source for supplying power to said illumination means;

(d) means for varying the power supplied to said illumination means as a function of the extent to which a portion of said toy bear is squeezed, said power varying means comprising a variable resistor mechanically connected with said portion; and (e) said squeezing portion including a compartment interior said toy bear, housing said power source and said power varying means and adapted to yield under squeezing pressure and provided with means to restore said compartment to its original posture.

6. The toy bear of claim 5 wherein said power source comprises two batteries.

7. The toy bear of claim 5 wherein said variable resistor comprises a wire-wound resistor.

8. A toy bear provided with a bashful demeanor and capable of exhibiting a variable blushing effect comprising:

(a) red-tinted light-transmitting face plate means defining cheek portions;

(b) illumination means comprising two lamps interior said toy bear, each associated with a cheek portion of said face plate means;

(c) a first, larger compartment interior said toy bear in the abdominal region, said first compartment comprising a compliant material;

(d) a second, smaller compartment within said first compartment, provided with an access door;

(e) a power source for supplying power to said illumination means, said power source comprising batteries located in said second compartment;

(f) means for varying the power supplied to said illumination means, comprising a rheostat electrically interconnected with said power source and said illumination means and mechanically connected with a portion of said first compartment; and (g) spring means within first compartment for maintaining said first compartment in an expanded condition, yet capable of yielding under pressure to permit power to said illumination means to be varied, whereby applying pressure to said first compartment causes said rheostat to move, the extent of movement being dependent upon the amount of pressure applied to said first compartment.

* * * * *